US006448499B1

(12) United States Patent
O'Brien

(10) Patent No.: US 6,448,499 B1
(45) Date of Patent: Sep. 10, 2002

(54) HIGH SPEED POLYPROPYLENE WIRE INSULATION FORMULATION AND METHOD OF MAKING THE SAME

(75) Inventor: Douglas D. O'Brien, Port Huron, MI (US)

(73) Assignee: Krone, Inc., Englewood, CO (US)

( * ) Notice: Subject to any disclaimer, the term of this patent is extended or adjusted under 35 U.S.C. 154(b) by 0 days.

(21) Appl. No.: 09/655,714

(22) Filed: Sep. 5, 2000

(51) Int. Cl.[7] ..... H01B 7/00

(52) U.S. Cl. ..... 174/110 R; 174/120 R; 174/120 SR

(58) Field of Search ..... 174/36, 110 R, 174/110 SR, 110 PM, 110 FC, 120 R, 121 A, 119 C

(56) References Cited

U.S. PATENT DOCUMENTS 3,817,783 A 6/1974 Verne et al.
4,259,410 A 3/1981 Dittmann et al.
4,352,701 A 10/1982 Shimba et al.
4,549,041 A * 10/1985 Shingo et al. ..... 174/113 R
4,997,995 A 3/1991 Simmons et al.
5,266,392 A * 11/1993 Land et al. ..... 428/224
5,478,891 A * 12/1995 Lakshmanan et al. ..... 525/240
5,539,056 A * 7/1996 Yang et al. ..... 525/240
5,656,371 A 8/1997 Kawahigashi et al.
5,770,820 A * 6/1998 Nelson et al. ..... 174/113 R
6,277,916 B1 * 8/2001 Terbrueggen et al. ..... 525/95

* cited by examiner

*Primary Examiner*—Dean A. Reichard
*Assistant Examiner*—William H. Mayo, III
(74) *Attorney, Agent, or Firm*—Rader, Fishman & Grauer PLLC

(57) ABSTRACT

A method for manufacturing a conductor that includes extruding insulation around a conductive wire. The insulation should be extruded directly onto and around the conductive wire. The insulating material includes a first medium impact grade polypropylene copolymer, a second medium impact grade polypropylene copolymer, and another polyolefin, where the first medium impact grade polypropylene copolymer has a melt flow index that is greater than the second medium impact grade polypropylene copolymer melt flow index. The insulation material can also include at least one flame retardant.

21 Claims, 1 Drawing Sheet

Figure 1:
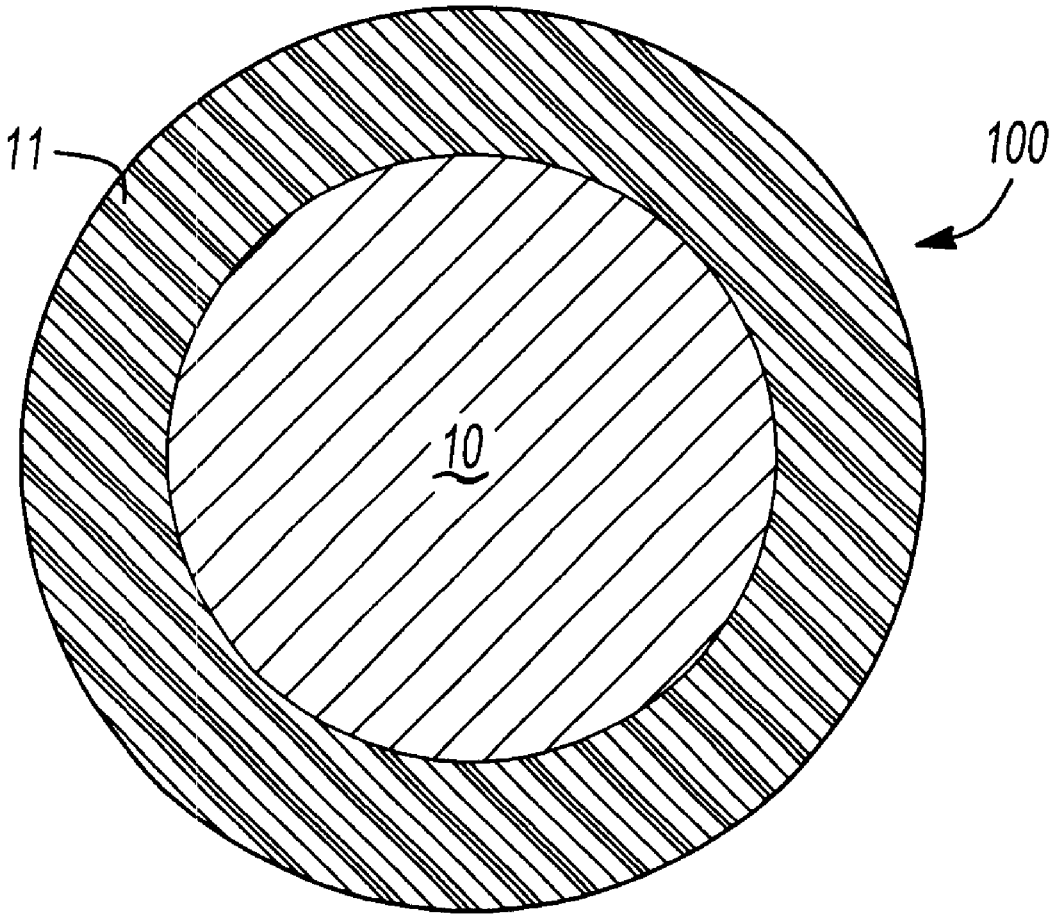

HIGH SPEED POLYPROPYLENE WIRE INSULATION FORMULATION AND METHOD OF MAKING THE SAME

BACKGROUND OF THE INVENTION

Polymers in various formulations have been used for decades as insulation for conductive wires. A commonly used polymer is polypropylene. Polypropylene is readily combinable with many other olefin polymers, and is manufactured in several different grades and in formulations with numerous other polymers by many manufacturers.

Existing wire and cable grades of polypropylene suffer, however, from several problems when the polypropylene is deposited at high line speeds. Probably the most significant of these problems is unstable flow pattern that occurs at the exit point where the polymer is extruded from an extruder die. Instability of the flow pattern results in an insulation wall that surrounds the conductor with varying centering properties. Further, the diameter of the insulation is nonuniform as a result of the unstable flow pattern. Uniformity in both of these two parameters is critically important, particularly for data carrying products such as LAN cables and associated wiring, most significantly the T1 cables and category 5 and higher cables.

Another problem associated with wire and cable grades of polypropylene deposited at high line speeds is an often-arising difficulty in achieving an acceptable bond to the conductor. Without an adequate conductor-insulation bond, poor impedance stability results in data cables. Consequently, high scrap losses result at the production stage.

Polyethylene is another common insulation material. There are difficulties associated with deposition of polyethylene insulation as well. For example, existing flame retarded high density polyethylene tends to generate excessive extrusion pressures when deposited at high line speeds, which consequently limits production rates. Also, it is common to see the extrusion tooling, including the screw that powers the extrusion, with an acquired coating or plate out of the flame retardant chemical during production. After some time, this plate out flakes off and causes numerous electrical faults in the coated wire. This nuisance suspends production until the affected parts are cleaned.

SUMMARY OF THE INVENTION

The present invention is directed to overcoming the problems of unstable flow and variable bonding between a conductor and insulation in a cable or wire at high line speeds which are typically about 6,000 ft/min (about 1828 meters/min) but can surpass 7,000 ft/min (about 2133 meters/min). The present invention is also directed to overcoming the problems of high extrusion pressures in thin wall extrusion, while concurrently eliminating the plate out problem. These improvements result in enhanced production rates and reduced scrap losses.

The invention is firstly directed to a method for manufacturing a conductor. First, at least one conductive wire is provided. Next, an insulating material is extruded around the conductive wire. The insulating material should be extruded directly onto and around the conductive wire. The extruding step can be performed at a speed that is greater than about 2,100 meters of conductive wire per minute.

The present invention is also directed to a conductor that is made according to the above method and includes at least the conductive wire and the insulating material. The insulating material includes at least a first medium impact grade polypropylene copolymer, and another polyolefin. The polypropylene is generally isotactic in structure. The first and second medium impact grade polypropylene copolymers each have a density of approximately 0.9 g/cm$^3$. The polyolefin is preferably a very low density polyethylene (less than or equal to 0.906 g/cm$^3$).

The extruding step includes extruding the insulating material at a thickness that is no greater than about 0.25 mm. The conductor is normally approximately 0.52 mm in diameter.

The insulation most preferably further includes a second medium impact grade polypropylene copolymer, where the first medium impact grade polypropylene copolymer has a melt flow index that is greater than the second medium impact grade polypropylene copolymer melt flow index. The second polypropylene also has a generally isotactic structure. The insulation material can also include at least one flame retardant. It is preferable that the flame retardant include at least one inorganic compound.

BRIEF DESCRIPTION OF THE PREFERRED EMBODIMENT

FIG. 1 shows a cross-sectional view of the conductor of the present invention.

DETAILED DESCRIPTION OF THE PREFERRED EMBODIMENT

As shown in FIG. 1, the conductor 100 of the present invention can be as simple as a single conductive wire 10 surrounded by a single layer of insulation 11. The invention can also include a cable that includes a plurality of conductors 100 intertwined, more particularly cables having a plurality of paired conductive wires, where the pairs are intertwined. Further, the invention can include wiring that has a plurality of individual conductors 100 side by side and separated by an insulation layer, or pairs of insulated conductors laid side by side and contained within a jacket. Other wiring can be manufactured using the method and the conductor 100 of the invention as well.

The conductive wire 10 is most preferably copper. However, many conductive materials can be used in place of, or in addition to copper. The conductive wire 10 can be of various sizes. In a preferred embodiment of the invention, the conductive wire 10 is approximately 0.5 mm in diameter. A major advantage of the present invention is the ability of the inventive insulation 11 to adhere to the copper conductive wire 10 even when extruded onto the conductive wire 10 at very high line speeds. The conductive wire 10 is more precisely centered than currently available wires having extruded insulation thereon, particularly the flame retarded embodiment where the conductive wire 10 is approximately about 0.52 mm in diameter and the insulation 11 has a thickness that is no greater than about 0.25 mm as it is at such dimensions where the above-mentioned problems i.e., rough outer diameter, etc. tend to occur.

Further, the insulation formulation 11 satisfies the stringent physical and electrical requirements for wire insulation. Moreover, the insulation 11 eliminates past common problems of unstable flow and variable wire bonding, even when being extruded at line speeds of about 1800 meters per minute, or even more than about 2100 meters per minute. The flame retardant embodiment of the invention overcomes the problem of high extrusion pressures, even in very thin wall extrusion, and also eliminates the plate out problems described above. Both the flame retardant embodiment and the non-flame retardant embodiment enable enhanced production rates and reduced scrap losses.

The following are example formulations of the insulation 11 First, an example formulation of the non-flame retardant embodiment is given in Table 1.

TABLE 1

| Type of Material | Material | Level | % |
|---|---|---|---|
| Polypropylene | Exxon ® PP7033 E2 ™ | 60.00 | 59.82 |
| Polypropylene | Exxon ® PP7032 E7 ™ | 30.00 | 29.91 |
| Polyethylene | Exxon ® Exact 3022 ™ | 10.00 | 9.97 |
| Stabilizer | Gr. Lakes Anox 20 ™ | 0.15 | 0.15 |
| Stabilizer | Gr. Lakes MD24 ™ | 0.15 | 0.15 |

TABLE 2

| Type of Material | Material | Level | % |
|---|---|---|---|
| Polypropylene | Exxon ® PP7033 E2 ™ | 60.00 | 42.16 |
| Polypropylene | Exxon ® PP7032 E7 ™ | 30.00 | 21.08 |
| Polyethylene | Exxon ® Exact 3022 ™ | 10.00 | 7.03 |
| Flame retardant | GLCC DE 83 ™ | 15 | 10.54 |
| Flame retardant | GLCC DE 79 ™ | 15 | 10.54 |
| Flame retardant | SB203 ™ | 12 | 8.43 |
| Stabilizer | Gr. Lakes Anox 20 ™ | 0.15 | 0.11 |
| Stabilizer | Gr. Lakes MD24 ™ | 0.15 | 0.11 |

As shown in the above tables, in either embodiment the insulation 11 includes at least one medium impact grade polypropylene copolymer, and an other polyolefin. The other polyolefin is most preferably very low density (no greater than 0.906 g/cm$^3$) polyethylene. It is also preferred that the insulation 11 include the polyethylene at a concentration of no more than about 10% by weight.

In a most preferred embodiment of the invention, the insulation 11 has a second medium impact grade polypropylene copolymer composition, where the first medium impact grade polypropylene copolymer has a melt flow rate that is greater than that of the second medium impact grade polypropylene copolymer. The melt flow rate is measured using the ASDN D1248 (230° C./2.16 kg) and is expressed in grams of flow per 10 minutes. For example, the formulations given in Table 1 and Table 2 provide two polypropylene materials. Exxon® PP7033 E2™ is copolymer grade polypropylene, a medium impact copolymer resin normally used for general purpose injection molding. The melt flow rate is typically 4.5, and the density is typically 0.90 g/cm$^3$. Exxon® PP7032 E7™ is also copolymer grade polypropylene, and is a medium impact copolymer resin normally used for general purpose injection molding. The melt flow rate is typically 8, and the density is typically 0.90 g/cm$^3$.

The advantages of using two polypropylene materials where each polypropylene material has a different melt flow rate include a resultant broad molecular weight distribution. When the polymer units have a broad distribution of molecular weight, the extrusion rate and overall speed of production can be increased to remarkably high levels while maintaining a smooth outer diameter of the insulation 11 on the conductor 100. This is particularly advantageous because the copolymer grade polypropylene is much less costly than currently-used polypropylene formulations. Further, the copolymer grade polypropylene of the current insulation 11 formulation can be colored to naturally provide brighter, more definite colors using standard color masterbatches than the currently used flame retarded polyolefins.

As shown in Table 2, the insulation 11 can further include at least one flame retardant. While examples of the flame retardant are provided in Table 2, it is not necessary that all of these be combined. A single flame retardant formulation may be adequate. However, in a preferred embodiment of the invention the flame retardant includes at least one inorganic compound. Further, a halogen containing compound is preferably contained in the flame retardant, although combinations of halogen containing compounds and halogen-free compounds may be incorporated as well. Additionally, the use of additives to suppress the heat release rate of the formulation can also be incorporated into the insulation with the flame retardant. Such additives may include silicone-based additives that function to suppress the heat release rate of the formulation.

As has been established by the above description, the conductor 100 is prepared by an extrusion method. It is crucial that to accomplish the advantages of the invention that the conductor 100 is prepared by extruding at least one insulation layer 11 directly onto and around the conductive wire 10. A major advantage of the method lies in the ability of the extrusion to be performed at a speed that is about 1800 meters of the conductive wire per minute, or even greater than 2,100 meters of the conductive wire per minute.

Having described an embodiment of the invention, it is to be understood that the invention is not limited to any of the precise embodiments described herein. Various changes and modifications could be effected by one skilled in the art without departing from the spirit or scope of the invention as defined in the appended claims.

What is claimed is:

1. A conductor, which comprises:

at least one conductive wire; and an insulating material extruded around said at least one conductive wire, wherein said insulating material comprises at least a first polypropylene copolymer, a second polypropylene copolymer and another polyolefin, wherein the polypropylene copolymers are generally isotactic.

2. A conductor according to claim 1, wherein said polyolefin is very low density polyethylene.

3. A conductor according to claim 1, wherein said insulating material has a thickness that is no greater than about 0.2 mm.

4. A conductor according to claim 1, wherein said at least one conductor is approximately 0.5 mm in diameter.

5. A conductor according to claim 1, wherein said first polypropylene copolymer has a melt flow index that is greater than a melt flow index of said second polypropylene copolymer.

6. A conductor according to claim 1, wherein each of said first and second polypropylene copolymers has a density of approximately 0.9 g/cm$^3$.

7. A conductor according to claim 1, wherein said insulation material further comprises at least one flame retardant.

8. A conductor according to claim 7, wherein said at least one flame retardant comprises an inorganic compound.

9. A conductor according to claim 1, wherein said insulating material is extruded directly onto and around said at least one conductive wire.

10. A conductor according to claim 1, wherein said insulation comprises no more than 10% by weight of said polyolefin.

11. A method for manufacturing a conductor, which comprises the steps of:

providing at least one conductive wire; and applying an insulating material around said conductive wire, wherein said insulating material comprises a first polypropylene copolymer, a second polypropylene copolymer and another polyolefin, wherein the polypropylene copolymers are generally isotactic.

12. A method according to claim 11, wherein said polyolefin is very low density polyethylene.

13. A method according to claim 11, wherein said applying step comprises applying said insulating material at a thickness that is no greater than about 0.2 mm.

14. A method according to claim 11, wherein said conductor is approximately 0.5 mm in diameter.

15. A method according to claim 11, wherein said first polypropylene copolymer has a melt flow index that is greater than a melt flow index of said second polypropylene copolymer.

16. A method according to claim 11, wherein said applying step is performed at a line speed that is greater than 2,100 meters per minute.

17. A method according to claim 11, wherein said insulation material further comprises at least one flame retardant.

18. A method according to claim 17, wherein said at least one flame retardant comprises an inorganic compound.

19. A method according to claim 11, wherein each of said first and second polypropylene copolymers has a density of approximately 0.9 g/cm$^3$.

20. A method according to claim 11, wherein said applying step comprises applying said insulating material directly onto and around said conductive wire.

21. A method according to claim 11, wherein said applying step is performed at a line speed that is greater than 1,800 meters per minute.

* * * * *